US011092291B2

(12) United States Patent
Hettenkofer

(10) Patent No.: US 11,092,291 B2
(45) Date of Patent: Aug. 17, 2021

(54) SAFETY VALVE FOR A PRESSURE VESSEL, COMPRISING A DISCHARGE LINE

(71) Applicant: Bayerische Motoren Werke Aktiengesellschaft, Munich (DE)

(72) Inventor: Simon Hettenkofer, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 403 days.

(21) Appl. No.: 15/975,855

(22) Filed: May 10, 2018

(65) Prior Publication Data

US 2018/0328540 A1 Nov. 15, 2018

Related U.S. Application Data

(63) Continuation of application No. PCT/EP2016/073894, filed on Oct. 6, 2016.

(30) Foreign Application Priority Data

Nov. 11, 2015 (DE) ..... 10 2015 222 252.7

(51) Int. Cl.
*F17C 13/04* (2006.01)
*F17C 13/12* (2006.01)

(52) U.S. Cl.
CPC ..... *F17C 13/04* (2013.01); *F17C 13/12* (2013.01); *F17C 2205/0332* (2013.01); *F17C 2205/0394* (2013.01); *F17C 2223/0123* (2013.01); *F17C 2223/036* (2013.01); *F17C 2250/0439* (2013.01); *F17C 2250/0491* (2013.01); *F17C 2260/042* (2013.01); *F17C 2270/0168* (2013.01)

(58) Field of Classification Search
CPC .. F17C 13/04; F17C 13/12; F17C 2205/0332; F17C 2205/0394; F17C 2223/0123; F17C 2223/036; F17C 2250/0439; F17C 2250/0491; F17C 2260/042; F17C 2270/0168
USPC ..... 220/89.4
See application file for complete search history.

(56) References Cited

U.S. PATENT DOCUMENTS 6,006,774 A 12/1999 Lhymn et al.
6,432,176 B1 * 8/2002 Klos ..... B82Y 30/00 206/0.7

(Continued)

FOREIGN PATENT DOCUMENTS

CN 102575788 A 7/2012
CN 104913186 A 9/2015

(Continued)

OTHER PUBLICATIONS

German Search Report issued in counterpart German Application No. 10 2015 222 252.7 dated Feb. 10, 2007 with partial English-language translation (Eighteen (18) pages).

(Continued)

*Primary Examiner* — J. Gregory Pickett
*Assistant Examiner* — Niki M Eloshway
(74) *Attorney, Agent, or Firm* — Crowell & Moring LLP

(57) ABSTRACT

A safety valve for a pressure vessel has a discharge line which extends away from a pressure relief unit. A substance fills an internal volume of the discharge line. At least one insulation element which is configured for at least reducing the thermal transmission in the discharge line in the axial direction of the discharge line is provided in the discharge line.

18 Claims, 3 Drawing Sheets

(56) References Cited

U.S. PATENT DOCUMENTS

| | | | | |
|---|---|---|---|---|
| 2008/0171248 | A1 | 7/2008 | Suess | |
| 2009/0101314 | A1* | 4/2009 | Lindner | F24V 30/00 165/104.26 |
| 2011/0127263 | A1* | 6/2011 | Lee | F17C 13/12 220/89.2 |
| 2011/0180551 | A1 | 7/2011 | Handa | |
| 2012/0199593 | A1 | 8/2012 | Jallais et al. | |
| 2013/0025716 | A1* | 1/2013 | Bohn | F17C 13/12 137/565.01 |
| 2014/0196535 | A1* | 7/2014 | Sawchuk | G01F 15/00 73/272 R |
| 2015/0252911 | A1 | 9/2015 | Kojima et al. | |
| 2015/0260347 | A1 | 9/2015 | Noguchi | |

FOREIGN PATENT DOCUMENTS

| | | |
|---|---|---|
| DE | 10 2008 003 607 | 7/2008 |
| DE | 10 2011 114 725 A1 | 4/2013 |
| EP | 1 655 533 A1 | 5/2006 |

OTHER PUBLICATIONS

International Search Report (PCT/ISA/210) issued in PCT Application No. PCT/EP2016/073894 dated Dec. 20, 2016 with English-language translation (Five (5) pages).

German-language Written Opinion (PCT/ISA/237) issued in PCT Application No. PCT/EP2016/073894 dated Dec. 20, 2016 (Seven (7) pages).

Chinese-language Office Action issued in counterpart Chinese Application No. 201680056141.2 dated Jul. 31, 2019 with English translation (13 pages).

* cited by examiner

SAFETY VALVE FOR A PRESSURE VESSEL, COMPRISING A DISCHARGE LINE

CROSS REFERENCE TO RELATED APPLICATIONS

This application is a continuation of PCT International Application No. PCT/EP2016/073894, filed Oct. 6, 2016, which claims priority under 35 U.S.C. § 119 from German Patent Application No. 10 2015 222 252.7, filed Nov. 11, 2015, the entire disclosures of which are herein expressly incorporated by reference.

BACKGROUND AND SUMMARY OF THE INVENTION

The technology disclosed herein relates to a safety valve for a pressure vessel, having a discharge line, and to a pressure vessel having such a safety valve. The technology relates in particular to a pressure vessel for storing fuel in a motor vehicle.

In the case of pressure vessels there is the risk of bursting due to a thermal event (for example a vehicle fire) acting on the pressure vessel. The rules (for example, EC79 or GTR (Global Technical Regulation ECE/TRANS/WP.29/2013/41)) therefore demand the installation of at least one thermal pressure relief valve (also referred to as a Thermal Pressure Release Device or TPRD) per pressure vessel. In the event of heat acting on these safety valves (for example by flames), the medium stored in the pressure vessel is discharged to the environment. The safety valves discharge the medium as soon as the triggering temperature at the safety valve is exceeded.

The TPRD is typically disposed at one end of a pressure vessel. At least two TPRDs are mandatory in the case of long pressure vessels (>1.65 m). Said two TPRDs are typically disposed in the longitudinal direction of the pressure vessel. The use of a plurality of safety valves increases the production costs and the space requirement. Nevertheless, the few valves along the large pressure vessels can in each case consider only a catchment area that is heavily restricted in spatial terms. A small local flame which acts on the tank between two valves can therefore severely damage the pressure vessel without the safety installation being activated. The damage to the pressure vessel, for example the damage to the load-bearing fiber composite material, that is created by the effect of the heat of a local flame can lead to a failure of the pressure vessel and to the latter bursting in the extreme case. Potentially, no TPRD may be provided at some critical locations, since insufficient installation space is available here (for example between the tank and the transmission tunnel).

A pressure vessel having a valve installation which has a safety device is known from DE 10 2011114725 A1. The safety device comprises a discharge line which is disposed in a risk zone that surrounds the pressure vessel. The safety device is activated by a change in the pressure in the discharge line. The discharge line is configured from metal and is filled with a medium. The pressure increase in the medium is intended to activate the safety device. A further device is known from EP 1 655 533 B1.

Should the thermal event not take place directly at the discharge line but at a certain spacing therefrom, or should this be a comparatively minor thermal flow, the thermal effect on the medium may potentially not be sufficient for adequately heating the comparatively large quantity of medium. The safety device in this instance is not triggered despite the pressure vessel being damaged by the local thermal event. Should a high temperature (that damages the vessel) be introduced only in a relatively small region, the metal tube and the medium by virtue of the positive thermal conductivity distribute the introduced quantity of heat to a relatively large area. The tube in this instance, in the regions that are more remote from the heat source, can discharge the introduced quantity of heat back to the environment. Moreover, the absolute temperature differential between the medium and the steel tube is reduced by virtue of the distribution of the heat. The aforementioned phenomena can lead to the safety valve not discharging the pressure or discharging said pressure in a delayed manner.

It is an object of the technology disclosed here, to reduce or to alleviate the disadvantages resulting from the prior art. It is furthermore a preferred object of the technology disclosed here to further improve the safety in the region of a pressure vessel and presently in particular in the region of a pressure vessel that in a motor vehicle is used as a hydrogen tank, and to provide in particular in a simple, efficient, small, and cost-effective manner a safely and reliably operating thermal safeguard of the vessel. In particular, it is an object of the technology shown here to reliably detect local thermal events which arise at a distance from a discharge line. It is also an objective of the technology shown here that the safety valve in the case of a thermal event reacts in a more rapid and/or more precise manner than solutions known to date. Further objects are derived from the advantageous effects of the technology disclosed here.

These and other objects are achieved in particular by a safety valve for a pressure vessel, having a discharge line which extends away from a pressure relief unit, and by a pressure vessel system having at least one pressure vessel and having a safety valve disclosed herein. The safety valve is in particular a thermal or thermally activatable, respectively, pressure relief valve, thus a TPRD.

Such a pressure vessel can be, for example, a cryogenic pressure vessel or a high-pressure gas vessel. High-pressure gas vessel systems are configured for permanently storing fuel substantially at environmental temperatures at a pressure of above approx. 350 bar(g) (=bar above atmospheric pressure), furthermore preferably of above approx. 500 bar(g), and particularly preferably of above approx. 700 bar(g).

The cryogenic pressure vessel system comprises a cryogenic pressure vessel. The cryogenic pressure vessel can store fuel in the liquid or supercritical aggregate state. The supercritical aggregate state refers to a thermodynamic state of a substance which has a higher temperature and a higher pressure than the critical point. The critical point refers to the thermodynamic state in which the density of gas and of liquid of the substance coincide, the latter thus being present in a single phase. While the one end of the vapor pressure curve in a pressure-over-time diagram is characterized by the triple point, the critical point represents the other end. In the case of hydrogen, the critical point is 33.18 K and 13.0 bar.

The pressure relief unit is the unit that is configured for releasing directly or indirectly the flow of combustion gas from the pressure vessel, so as to depend on a pressure value or a pressure signal (the term "pressure signal" being used hereunder), respectively of the discharge line explained hereunder. For example, the pressure relief unit can be configured for ensuring the outflow of combustion gas from the pressure vessel in the case of an increase in pressure above a trigger pressure (in the discharge line, or in the pressure relief unit, respectively) and/or in the case of a pressure drop below a trigger pressure. The combustion gas in the case of an in particular local thermal event (hereunder: "thermal event") that arises preferably adjacent to the discharge line, for example a local heating of the pressure tank above a local limit temperature, can thus be safely discharged. The limit temperature can be chosen such, for example, that any damage to the pressure tank can be reliably excluded. For example, the limit temperature can be below 300° C., preferably below 150° C., and particularly preferably below 120° C. However, the limit temperature is preferably above at least 85° C.

The pressure relief unit can be configured in particular as an overpressure valve which releases the content of the pressure vessel when the trigger pressure in the discharge line by virtue of the local heating exceeds a limit value. The pressure relief unit is preferably a valve which after the unit has opened remains in the open state without closing again when the local temperature at the location of the thermal event drops back to a value below the local limit temperature. Such a pressure relief unit is, for example, in DE 10 2011114725 A1 (cf. FIGS. 2 and 3, and the description thereof; therein referred to as the safety device), and in EP 1 655 533 B1 (cf. FIGS. 2 and 4 and the description thereof; therein referred to as the relief valve). The content of DE 10 2011114725 A1 and of EP 1 655 533 B1 in terms of the principle of the pressure relief unit, by way of reference is hereby incorporated in the present disclosure. A further preferred solution is shown hereunder in the context with a bursting installation.

The discharge line can be a line, in particular a tube, which preferably at least in regions extends across the surface of the pressure vessel. The discharge line preferably runs at least in regions in the axial direction and/or in the circumferential direction of the pressure vessel. The discharge line particularly preferably runs in a helical or spiral shape, respectively, or in a meandering shape, across the surface of the pressure vessel. Adjacent portions of the discharge line are preferably spaced apart in such a manner that a thermal event that arises between said adjacent portions is reliably detected, or the safety valve reliably discharges the combustion gas, respectively, before the pressure vessel is damaged.

The discharge line can in particular be configured so as to be pressure-resistant in particular in such a manner that the discharge line by virtue of an operational increase in pressure does not expand and/or is not damaged and/or does not close by virtue of a non-operational mechanical influence. An operationally reliable safety valve can thus advantageously be produced.

The line is preferably made from a metal. The line can furthermore preferably be configured from a material having a melting point far above the limit temperature. A discharge line which in the radial direction has a better thermal conductivity than in the axial direction of the discharge line is particularly preferred. A heat transmission to the substance described hereunder is thus advantageously enforced, whereas a dissipation of heat along the discharge line that is typically undesirable can be reduced.

A substance or a material S, respectively, is disposed at least in regions in the discharge line. The substance can be, for example, a pure substance or a mixture of substances. The substance can in particular be a solid substance, a liquid, or a gas (mixtures in one of these aggregate states). The substance S at least in regions fills the internal volume of the discharge line. The discharge line, or the internal volume thereof, respectively, is preferably completely filled with the substance S. The substance S expediently freezes only at a temperature below −60° C. The substance S is preferably a water/glycol mixture. The substance is in particular not the stored combustion gas.

The substance S can be configured for changing the substance volume and/or the pressure in the internal volume (or at least in a part-volume of the internal volume, respectively) so as to depend on the substance temperature.

Only the case in which the temperature of the substance and thus conjointly also the substance volume, or the pressure, respectively, in the discharge line is increased as a result of the thermal event is discussed hereunder. In an analogous manner it would also be conceivable that a reduction in the volume, or a reduction in the pressure, respectively, is implemented by virtue of an anomaly in terms of density or of a phase change.

A substance of which the substance density within a trigger temperature window of the safety valve changes very intensely and/or erratically and/or inconsistently in line with the substance temperature, for example by virtue of an at least partial phase change, also referred to as a phase transformation, is particularly preferably used. The temperature related isochoric state change causes an increase in pressure. The latter is preferably particularly intensely pronounced (that is to say a high increase of the pressure vapor curve in the pressure-over-time diagram) in the trigger temperature window. For example, the vapor pressure thus changes by a factor of at least 50 (for example, at glycol/water mixture from 0.02 bar at 25° C. to 1 bar at 110° C.), preferably by a factor of at least 100, wherein the freezing of the substance (for example at temperatures below −40° C.) is not considered. In the case of such a phase change of the substance, the pressure in a constant (part-) volume changes by virtue of an increase in temperature. As the temperature rises, the mixture increasingly begins to boil, and the vapor pressure will rise sharply. A water/glycol mixture which boils in the trigger temperature window and reaches a vapor pressure of more than 1 bar is particularly preferably used. Furthermore, liquids or else gases can be used, the vapor pressure curves of said liquids or gases in the operating temperature range of the motor vehicle (−40° C. to 85° C.) having a low change in the vapor pressure and preferably being present in the liquid state and being imparted an intense increase in vapor pressure in the trigger temperature range, such as butane, for example. This increase in pressure within the discharge line can expediently serve directly or indirectly as the trigger signal for the pressure relief unit. The increase in pressure is preferably very much more than 1 bar, in particular in order for the tolerance of the trigger installation to be able to be maintained in a range that is simple to produce. A phase change is generally the transformation of one or a plurality of phases of a substance to other phases. The stability ranges of the phases depending on the state variables such as pressure, temperature, chemical composition, and magnetic field strength, are known and are typically illustrated in phase diagrams or vapor pressure curves. Phase changes can arise inter alia between solid, liquid, and gaseous phases. The trigger temperature window is preferably defined by one of the following temperature ranges: approx. 95° C. to approx. 300° C., furthermore preferably approx. 95° C. to approx. 115° C., and particularly preferably approx. 105° C. to approx. 115° C. Should a thermal event now take place adjacent to the discharge line, the substance S within the discharge line is thus heated. Should the substance temperature rise to a value within the trigger temperature window, for example in the case of a glycol/water mixture, butane or a mixture comprising butane, respectively, to approx. 110°

C., an increase in pressure in the discharge line by virtue of the at least partial phase change arises, said increase in pressure in turn actuating the pressure relief unit.

In other words, a phase transformation which leads to an increase in pressure can thus be induced by the thermal input in a heat-conducting (discharge)line/jacket/body that is filled with a liquid (inter alia water+coolant, butane) or a solid material. It is expedient herein for the discharge line that contains the medium to be able to amplify or dampen the effect by way of the thermal expansion of the former. Therefore, a discharge line which has a thermal expansion that is as low as possible or has a negative coefficient of thermal expansion is preferably used. In particular, the coefficient of thermal expansion of the discharge line in the trigger temperature window is lower than the coefficient of thermal expansion of the substance S by at least a factor of 5, preferably by a factor of 10.

At least one insulation element is provided in the discharge line. The insulation element can be configured in particular for at least reducing, preferably suppressing, the thermal transmission $W_A$ in the discharge line (and in particular in the substance S) in the axial direction A of the discharge line. The at least one insulation element is preferably configured and in the assembled state disposed in such a manner that the at least one insulation element in the discharge line, (that is to say in the discharge line per se and/or in the internal volume of the discharge line, in particular in the substance S) permits a higher thermal transmission $W_R$ in the radial direction R of the discharge line than in the axial direction A of the discharge line. The thermal transmission $W_R$ in the radial direction R of the discharge line into the substance S herein is typically not changed or changed only to a minor extent by the at least one insulation element. It can thus be advantageously achieved that the amount of heat that is dissipated by the locally arising thermal event (for example a local flame) is largely utilized for a locally induced change of state of the substance. In other words, a part-volume of the substance S is more rapidly heated by way of the limited thermal transmission in the axial direction A. A trigger signal can thus be transmitted to the pressure relief unit in a more rapid, more precise, and more reliable manner. Delayed triggering which could mean damage to the pressure vessel can thus be advantageously avoided. According to the technology disclosed herein, the axial thermal conduction in the tube/medium is restricted in a targeted manner in order for the pressure to be increased in the case of a local event. To this end, suitable separation members that restrict the thermal conduction and function as insulation elements can in particular be incorporated in a manner vertical to the longitudinal direction of the discharge line.

The discharge line preferably has a normal operating pressure range in which the pressure relief unit reliably suppresses the flow of combustion gas through the pressure relief unit. A bursting installation that is disclosed here advantageously has a bursting installation trigger pressure at which the bursting installation bursts. The pressure relief unit can furthermore be configured for enabling the flow of combustion gas through the pressure relief unit at a pressure below the chamber trigger pressure.

The bursting installation trigger pressure is preferably above, preferably at least approx. 10% above, furthermore preferably at least 20% above, the maximum normal operating pressure of the discharge line. Furthermore preferably, the chamber trigger pressure is below, preferably at least approx. 10% below, furthermore preferably at least 20% below, the minimum normal operating pressure of the discharge line.

The at least one insulation element can be configured for subdividing the internal volume of the discharge line into a plurality of part-volumes. The internal volume herein can be the volume that is filled by the substance S. The at least one insulation element can furthermore be configured for establishing a fluid communication between part-volumes that are disposed so as to be directly adjacent or adjacent to one another, respectively, in particular in the case of a pressure limit value being exceeded in at least one of the part-volumes. The at least one insulation element can furthermore be configured for separating the part-volumes that are disposed so as to be adjacent from one another in the case of the pressure limit value being undershot in at least one of the part-volumes.

The at least one insulation element can be configured so as to be displaceable in the axial direction A of the discharge line. The at least one insulation element can be configured and disposed in the discharge line in such a manner that said insulation element is displaced in the axial direction A within the discharge line when a pressure differential limit value between adjacent part-volumes is exceeded. In particular, the insulation element can be jammed in the discharge line by way of a respective interference fit which permits a displacement above a specific pressure differential. The at least one insulation element can be configured for suppressing a fluid communication between adjacent part-volumes. The insulation element can thus be a seal element. The at least one insulation element is particularly preferably configured as an non-compressible plug (for example from an elastomer) which above a specific increase in pressure in the part-volume can be displaced in relation to the remaining volumes. The displaceability can be capable of being set, for example, by way of the interference fit and of the friction between the plug and the discharge line.

Separating from one another herein also comprises configurations in which (leakage) flows arise between adjacent part-volumes, as long as those flows are so minor that the thermal transmission in the axial direction A is below, or significantly below, respectively, the thermal transmission in the radial direction R.

The at least one insulation element at least in regions can be configured as a disk. Such an insulation element can be incorporated in the trigger installation in a particularly easy manner, in particular also when the discharge line is attached in a helical manner about the pressure vessel.

The disk, in the central region thereof and/or in the peripheral region thereof, can be configured so as to be flexural and/or burstable, in particular in such a manner that the insulation elements flex or burst, respectively, once the pressure limit value has been exceeded, on account of which a fluid communication is established between adjacent part-volumes. The force that is to be applied for the deformation/bursting is preferably as low as possible such that the pressure signal can be transmitted up to the burst or pressure valve unit with losses that are as minor as possible. The disk can in particular also be configured as a foil/film, preferably having a wall thickness of less than 1 mm, preferably of less than 500 μm or 100 μm.

Alternatively or additionally, the at least one insulation element can have at least one passage. The at least one passage herein is configured in such a manner that said passage establishes a fluid communication between (directly) adjacent part-volumes, on the one hand, but on the other hand does not increase the axial thermal transmission by virtue of a fluid flow in such a manner that the thermal transmission $W_A$ in the axial direction A is not lower, or significantly lower, respectively, than the thermal transmission $W_R$ in the radial direction R of the discharge line. Depending on the density or on the viscosity, respectively, of the substance, the passage can be of variable dimensions, wherein smaller passages can be provided in the case of a lower density/viscosity. The area of the clearance is preferably less than 20%, furthermore preferably less than 10%, and particularly preferably less than 5% of the cross-sectional area of the discharge line. By way of such a passage, the pressure signal that is generated locally by virtue of the thermal event can be reliably transported in a simple manner to the pressure relief unit.

The safety valve can have at least two insulation elements which by way of at least one spacer means are mutually spaced apart. Such a spacer means can be, for example, a stay or a web which extends away from a disk-shaped portion. Such a spacer means can furthermore be a thread or a flexible bar to which the insulation elements are attached so as to be mutually spaced apart. For assembly, this unit consisting of insulation elements and spacer means is pushed into the discharge line. Furthermore, the insulation elements by way of the at least one spacer means could be fixed only during the assembly, for example in the case of the insulation elements by way of the assembly being fastened, for example shrink-fitted, adhesively bonded, or welded, to the discharge line. It would also be conceivable for the insulation elements in a compressed state to be first positioned prior to the insulation elements in a subsequent method step jamming in the discharge line, in a similar manner as with a stent in a blood vessel. The insulation element can advantageously be jammed in such a manner that it is displaced above the limit differential pressure between adjacent part-volumes. The at least one spacer means can in particular be configured so as to be flexural. Furthermore, the at least one spacer means can be connected to the at least one insulation element in the peripheral region and/or in the central region, or can at least in regions bear on the at least one insulation element.

The safety valve disclosed herein can furthermore have a discharge line having a separate bursting installation in the discharge line. This separate bursting installation can initially be provided so as to be functionally independent of the at least one insulation element. However, both the bursting installation as well as the at least one insulation element are preferably provided. Consequently, the discharge line per se does not function as the bursting installation. This offers the advantage that a separate bursting installation can trigger in a more precise and more reliable manner. Furthermore, a more stable discharge line that is thus less prone to failure can be used. Moreover, a destroyed bursting disk can be replaced more readily and more cost-effectively than the complete discharge line which is typically larger and shaped in a more complicated manner. The bursting installation is expediently disposed and configured in such a manner that the substance S after a bursting event can escape to the environment such that a depressurization which can then cause triggering of the safety valve arises in the discharge line and in the pressure relief unit. The bursting installation is particularly preferably provided on the free end of the discharge line. Said bursting installation can be particularly well integrated here. Furthermore, a simpler construction of the discharge line results in this instance, since all part-volumes can be of identical design.

In other words, the technology disclosed herein relates inter alia to a safety valve having a discharge line and a bursting disc or a valve, which triggers and thus by means of a directly or pre-actuated valve can initiate a depressurization of a pressure vessel. To this end, insulation elements which indeed restrict the thermal conduction however permit a pressure equalization, for example by way of a bore, can be incorporated in a manner vertical to the longitudinal direction A, as has already been mentioned. The line geometry of the discharge line permits an integral, linear or planar detection of critical temperatures and thus better protection of pressure vessels by way of fire or impermissible high temperature prior to bursting.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
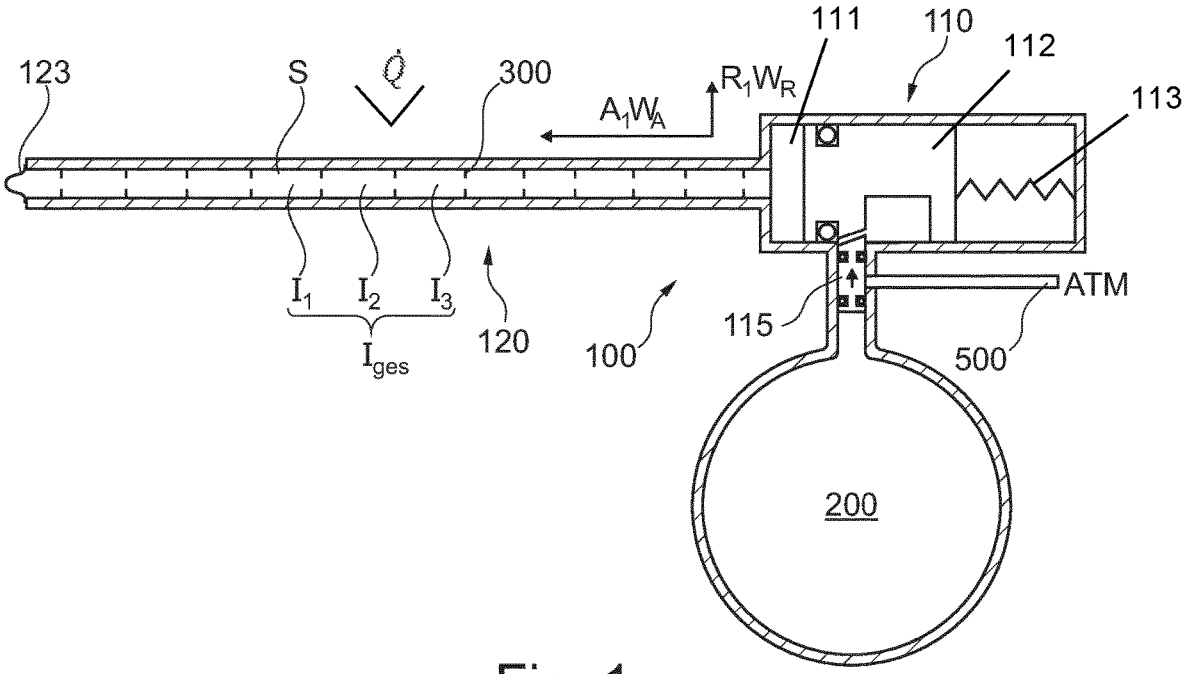
FIG. 1 is a schematic cross-sectional view of the safety valve 100.

FIG. 1 shows a cross-section through a safety valve 100 disclosed herein. The safety valve 100 is attached to one end of a pressure vessel 200. The assembly of the safety valve 100 on the pressure vessel 200 can be designed in various ways. The safety valve 100 is typically attached directly to the pressure vessel 200. The safety valve 100 comprises a pressure relief unit 110 and a discharge line 120. The discharge line 120 is in fluid communication with an internal chamber 111 of the pressure relief unit 110. A piston 112 which in turn is pretensioned by pretensioning means (presently a spring) 113 is disposed in the internal chamber 111.

The discharge line 120 and the chamber 111 of the pressure relief unit 110 are filled with the substance S, presently a water/glycol mixture S. A plurality of insulation elements 300 which presently are embodied as disks, each having one passage, are disposed in the discharge line 120. The insulation elements 300 are disposed so as to be mutually spaced apart and subdivide the internal volume $I_{gas}$ of the discharge line 120 into a plurality of part-volumes $I_1$, $I_2$, $I_3$. The part-volumes $I_1$, $I_2$, $I_3$ are in mutual fluid communication by way of the passages in the insulation elements 300. Therefore, an almost identical operating pressure (for example, such as 1.3 bar (=bar atmospheric pressure) to 1.5 bar at room temperature in the case of a water-glycol mixture) prevails in all part-volumes $I_1$, $I_2$, $I_3$ and in the chamber 111. The insulation elements 300 furthermore have the effect that the thermal transmission $W_A$ in the discharge line 120 in the axial direction A is at least below that of a design embodiment without insulation elements 300. The insulation elements 300 thus reduce the thermal transmission $W_A$ which would otherwise, for example, be forced by the fluid flow from the free end in the direction of the pressure relief unit 110 and by the Brownian molecular motion.

Should a thermal event (presently illustrated as a local thermal flow Q), for example a local flame, now act locally on the discharge line 120, the part-volume $I_2$ is thus heated. Since the part-volume $I_2$ at both sides is delimited by insulation elements 300, comparatively little heat is transmitted away from the part-volume $I_2$. The part-volume $I_2$ is thus heated more rapidly than a volume of equal size which is not delimited by insulation elements 300. A phase change which is associated with a significant increase in the pressure $p_2$ (for example to 2 bar) in the part-volume $I_2$ can thus advantageously be implemented by way of a minor thermal flow $\dot{Q}$ in a part-volume $I_2$. Since the individual part-volumes $I_1$, $I_2$, $I_3$ are in fluid communication by way of respective passages, and the liquid remains largely non-compressible, the pressure in the other part-volumes also rises. A bursting installation 123 is advantageously provided in the discharge line 120 in the design embodiment shown here. The bursting installation 123 is conceived such that the bursting installation 123 bursts when the pressure rises to a pressure above a bursting installation trigger pressure (for example 1.8 bar). When the bursting installation 123 is destroyed, the liquid escapes from the discharge line 120. This has the effect that the liquid also escapes from the chamber 111. The pressure in the chamber 111 now drops to below a chamber trigger pressure (for example 1.1 bar) of the pressure relief unit 110. The counterforce to the pretensioning means 113 that is applied on account of the pressure in the chamber 111 is now no longer sufficient in order for the piston 112 to be held in the flow-blocking position. Therefore, the piston is displaced from the flow-blocking position to a position in which the flow of fuel through the pressure relief unit 110 is enabled. To this end, a plug 115 can escape into a clearance of the piston 112, for example. The escaped plug 115 vacates the flow path 500 to the environment. The pressure in the pressure vessel 200 is then diminished in a safe manner in this position of the piston 112.

According to the solution shown here, the thermal event Q first causes a buildup of pressure to a pressure value above the bursting installation trigger pressure. After the destruction of the bursting disk a depressurization takes place in the discharge line 120 and triggering of the pressure relief unit 110 thus takes place. Such a design embodiment has the advantage that potential leakages in the discharge line 120 would also lead to a depressurization in the discharge line 120 and thus to the discharge of fuel. Such a system is thus safer than systems in which an increased pressure moves the pressure relief unit 110 directly to an open position (for example without a bursting installation). In principle, however, the latter would also be within the scope of the technology disclosed herein.

Figure 2:
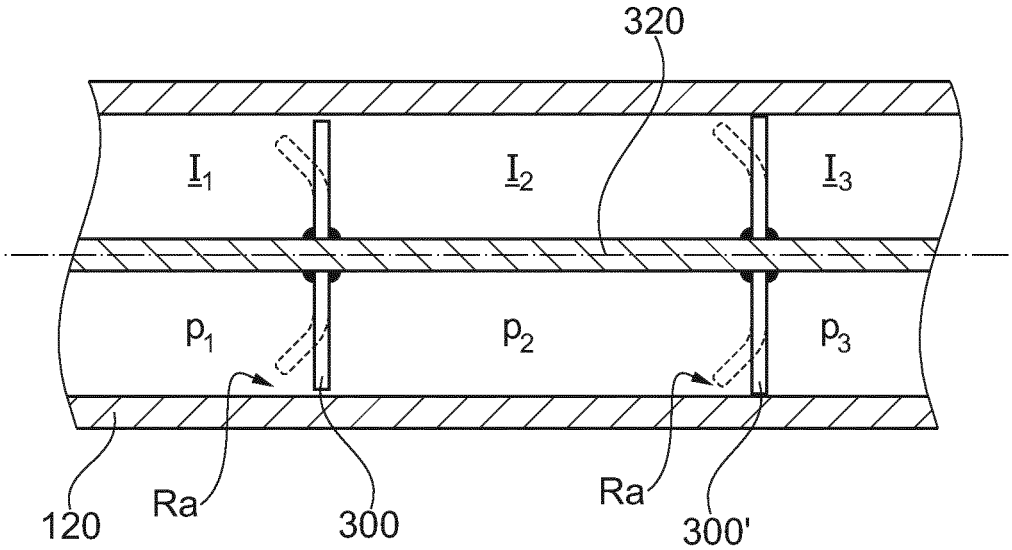
FIG. 2 is a schematic cross-sectional view of a discharge line 120.

FIG. 2 shows an enlarged detailed view of two insulation elements 300, 300', which delimit the part-volume $I_2$. The insulation elements 300, 300' are positioned by a spacer means 320, presently a flexible bar or a dimensionally stable thread, respectively, in particular in such a manner that the insulation elements 300, 300' are mutually spaced apart and define a part-volume $I_2$ of the internal volume $I_{gas}$ of the discharge line 120. The insulation elements 300, 300' illustrated with dashed lines are in the state in which the substance S in the part-volume $I_2$ has been heated in such a manner that at least a partial phase change has taken place. In that event, the pressure p2 in the part-volume 12 increases sharply. The increase in pressure has the effect that a pressure differential arises between adjacent part-volumes. Should this pressure differential exceed a specific value, the pressure differential causes the peripheral regions Ra, Ra' of the insulation elements 300, 300' to flex. A fluid communication between adjacent part-volumes is created in this instance. A pressure equalization is associated with the fluid communication such that the part-pressures $p_1$, $p_2$, $p_3$ in the part-volumes $I_1$, $I_2$, $I_3$ are substantially identical. As has already been described in the context of FIG. 1, the increase in pressure in the discharge line 120 causes the destruction of the bursting disk on account of a pressure above the bursting installation trigger pressure (for example 2 bar) in the discharge line 120. A depressurization to a pressure value (for example 1 bar) then arises in the discharge line 120, said pressure value being below the normal operating pressure (for example 1.5 bar) in the discharge line 120. This in turn has the effect that the insulation elements 300, 300' flex in the opposite direction (thus to the left in FIG. 2). In turn, a fluid communication between adjacent part-volumes is thus created which has the effect that a depressurization arises in the chamber 111. The piston 111 of the pressure relief unit 110 is displaced and thus opens the safety valve 100 (not shown in FIG. 2).

Figure 3:
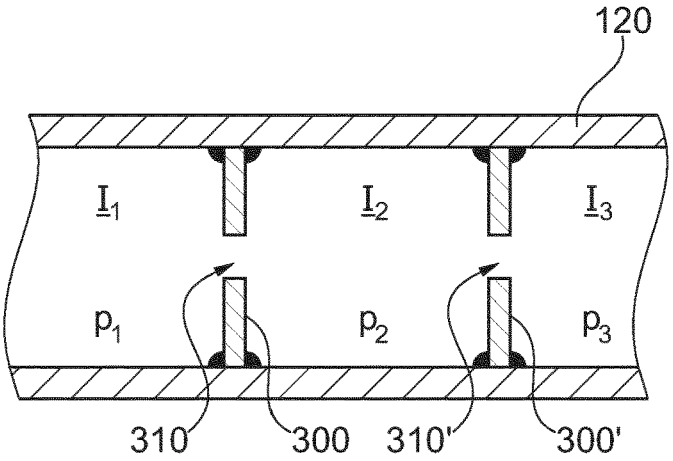
FIG. 3 is a further schematic cross-sectional view of a discharge line 120.

FIG. 3 shows an enlarged view of the insulation elements 300, 300' of FIG. 1. The passages 310, 310' which separate the different part-volumes $I_1$, $I_2$, $I_3$ from one another are disposed in the central region. In the design embodiment shown here, the insulation elements 300, 300' are fixedly connected to the discharge line 120. The insulation elements 300, 300' could also be configured without passages 310, 310'. Furthermore, the insulation elements 300, 300' could be held in the discharge line 120 only in such a manner that the insulation elements 300, 300' are displaced when a pressure differential limit value between adjacent part-volumes $I_1$, $I_2$, $I_3$ is exceeded.

Figure 4:
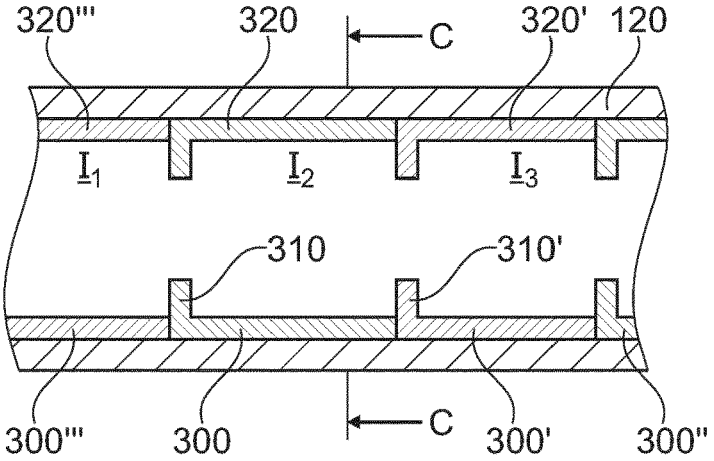
FIG. 4 is a further embodiment of a discharge line 120.

FIG. 4 shows a further embodiment of the insulation elements 300, 300'. The insulation elements 300, 300' comprise a disk-shaped region, spacer elements 320, 320' extending away from the latter. The spacer elements 320, 320' here are expediently configured as stays or webs, respectively, and space apart the disk-shaped regions of adjacent insulation elements 300, 300'. Passages 310, 310' are again disposed in the central regions of the disk-shaped regions.

Figure 5:
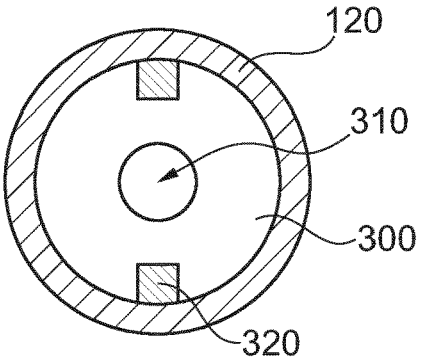
FIG. 5 is a cross-sectional view along the line C-C of FIG. 4.

FIG. 5 shows a cross-sectional view along the line C-C. The passage 310 is shown in the central region, and two stays 320 are shown here in the peripheral region.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A safety valve having a pressure relief unit for a pressure vessel, comprising:

a discharge line which extends away from the pressure relief unit, wherein a substance fills an internal volume of the discharge line, a separate bursting installation functions as a bursting installation, the separate bursting installation not being the discharge line itself, the discharge line is equipped with the bursting installation, wherein the discharge line has a first distal end that is attached to the pressure relief unit and a second distal end that is disposed spaced apart from the pressure relief unit, wherein the second distal end is a free end of the discharge line; and the bursting installation is provided on the free end of the discharge line.

2. The safety valve as claimed in claim 1, wherein the bursting installation is disposed and configured such that the substance, after a bursting event, escapes to an environment such that a depressurization arises in the discharge line and in the pressure relief unit.

3. The safety valve as claimed in claim 1, further comprising:

at least one insulation element which is configured for at least reducing thermal transmission at least in an internal volume in an axial direction of the discharge line.

4. The safety valve as claimed in claim 3, wherein the thermal transmission in a radial direction of the discharge line on account of the at least one insulation element is not changed or changed only to a limited extent.

5. The safety valve as claimed in claim 4, wherein the at least one insulation element is configured for subdividing the internal volume of the discharge line into a plurality of part-volumes.

6. The safety valve as claimed in claim 5, wherein the at least one insulation element is configured so as to be displaceable in the axial direction of the discharge line.

7. The safety valve as claimed in claim 3, wherein the at least one insulation element is configured for subdividing the internal volume of the discharge line into a plurality of part-volumes.

8. The safety valve as claimed in claim 7, wherein the at least one insulation element is configured for suppressing a fluid communication between adjacent part-volumes; and/or the at least one insulation element is configured for establishing a fluid communication between adjacent part-volumes in the case of the pressure differential limit value being exceeded.

9. The safety valve as claimed in claim 8, wherein the at least one insulation element has at least one passage.

10. The safety valve as claimed in claim 3, wherein the at least one insulation element is configured so as to be displaceable in the axial direction of the discharge line.

11. The safety valve as claimed in claim 10, wherein the at least one insulation element is configured and disposed in the discharge line in such a manner that said insulation element is displaced within the discharge line in the axial direction of the discharge line when a pressure differential limit value between adjacent part-volumes is exceeded.

12. The safety valve as claimed in claim 10, wherein the at least one insulation element is configured for suppressing a fluid communication between adjacent part-volumes; and/or the at least one insulation element is configured for establishing a fluid communication between adjacent part-volumes in the case of the pressure differential limit value being exceeded.

13. The safety valve as claimed in claim 3, wherein the at least one insulation element at least in regions is configured as a disk, and the at least one insulation element in a central region and/or in a peripheral region is configured so as to be flexural and/or burstable.

14. The safety valve as claimed in claim 13, wherein the at least one insulation element has at least one passage.

15. The safety valve as claimed in claim 3, wherein the safety valve has at least two insulation elements which by way of at least one spacer are mutually spaced apart.

16. The safety valve as claimed in claim 15, wherein the at least one spacer is configured so as to be flexural, and in a peripheral region and/or in a central region the spacer is connected to the at least one insulation element, or at least in regions bears on the at least one insulation element.

17. A safety valve having a pressure relief unit for a pressure vessel, comprising:

a discharge line which extends away from the pressure relief unit, wherein a substance fills an internal volume of the discharge line and wherein a separate bursting installation functions as a bursting installation, the separate bursting installation not being the discharge line itself; and at least one insulation element which is configured for at least reducing thermal transmission at least in an internal volume in an axial direction of the discharge line, wherein the at least one insulation element is configured for subdividing the internal volume of the discharge line into a plurality of part-volumes, and the at least one insulation element is configured and disposed in the discharge line in such a manner that said insulation element is displaced within the discharge line in the axial direction of the discharge line when a pressure differential limit value between adjacent part-volumes is exceeded.

18. A safety valve for a pressure vessel, comprising:

a pressure relief unit;

a discharge line which extends away from the pressure relief unit, wherein a substance fills an internal volume of the discharge line, a separate bursting installation functions as a bursting installation, the separate bursting installation not being the discharge line itself, the discharge line is equipped with the bursting installation, wherein the discharge line has a first distal end that is attached to the pressure relief unit and a second distal end that is disposed spaced apart from the pressure relief unit, wherein the second distal end is a free end of the discharge line; and the bursting installation is provided on the free end of the discharge line.

* * * * *